US006033239A

United States Patent [19]

Jaakkola et al.

[11] Patent Number: 6,033,239

[45] Date of Patent: Mar. 7, 2000

[54] CONNECTOR FOR TRACK LIGHTING SYSTEMS

[76] Inventors: Risto Jaakkola, Pyytie 4A 02340; Eero Nieminen, Jàäskeläntie 33 02660, both of Espoo; Esko Vaisanen, Pietarinmäentie 11B 01800, Klaukkala, all of Finland

[21] Appl. No.: 09/173,634

[22] Filed: Oct. 16, 1998

[51] Int. Cl.[7] ..... H01R 25/00

[52] U.S. Cl. ..... 439/121; 439/94

[58] Field of Search ..... 439/110–122, 94

[56] References Cited

U.S. PATENT DOCUMENTS

| | | | |
|---|---|---|---|
| 3,894,170 | 7/1975 | Schinzel | 439/110 |
| 3,933,403 | 1/1976 | Rubesamen et al. | 439/121 |
| 4,609,979 | 9/1986 | Kristofek . | |
| 4,626,969 | 12/1986 | Kristofek . | |
| 4,755,920 | 7/1988 | Tinley . | |
| 4,851,973 | 7/1989 | Layne . | |
| 4,919,625 | 4/1990 | Coutre . | |
| 5,013,251 | 5/1991 | Stringer et al. | 439/94 |
| 5,574,600 | 11/1996 | Agro . | |
| 5,653,412 | 8/1997 | Martorano et al. . | |
| 5,664,876 | 9/1997 | Vafai et al. | 439/113 |

*Primary Examiner*—Gary F. Paumen
*Attorney, Agent, or Firm*—Jones & Askew, LLP

[57] ABSTRACT

An improved connector is disclosed for a track lighting system in which a light fixture is physically and electrically connected to a track. The track is elongated and defines a central longitudinal passageway. A voltage bus, a neutral bus, and a grounding element are disposed within the central longitudinal passageway. Means disposed above the central longitudinal passageway define a pair of opposing channels. The connector comprises a housing and a flange extending from the housing. The flange is received within an end of the central longitudinal passageway of the track by way of an interference fit, and the flange has electrical contacts for engaging the voltage bus, the neutral bus, and the grounding element disposed within the central longitudinal passageway. The connector further includes a tongue extending from the housing spaced apart from and generally parallel to the flange and having edge portions which engage the opposing channels of the track in an interference fit. The engagement between the tongue and the channels of the track enhances the physical connection between the connector and the track.

13 Claims, 14 Drawing Sheets

CONNECTOR FOR TRACK LIGHTING SYSTEMS

TECHNICAL FIELD

The present invention relates generally to track lighting and relates more specifically to an improved mechanism for connecting adjacent track components.

BACKGROUND OF THE INVENTION

Track lighting systems wherein lighting fixtures are mounted to tracks and supplied electrical power by busses associated with the track are well known. The tracks are generally hollow elongated extrusions of aluminum or other suitable material. Channels are formed on the interior walls of the hollow track within which are mounted insulating carriers holding electrical busses. Typically the track will be provided with one or more voltage busses, a neutral bus, and a grounding element. The grounding element can be either a ground bus or a rib of the track extrusion. A lighting fixture is mounted to the track by way of a track adapter. Electrical contacts on the adapter contact the electrical busses carried by the track to supply power to the light fixture.

Connectors are used to supply electrical current to the track and to connect adjacent track sections. The connector has a nose portion which is snugly received within the end of the hollow track by way of an interference fit to mechanically couple the connector to the track section. Electrical contacts extending from lateral surfaces of the nose of the connector contact the voltage and neutral busses and the grounding element within the track to effect electrical connections between the connector and the track section.

There are two basic types of connectors. The first type of connector, known as a "feed," has either a single nose for connecting to a single track section, or multiple noses for connecting to multiple track sections. Each nose portion has electrical contacts in electrical communication with corresponding neutral and voltage busses and a grounding element of the track. Wires connected to a source of electrical power are connected to terminals within the connector so that the feed provides the track section or sections with electrical power.

The second type of connector physically and electrically connects two or more pieces of track. The connector has a plurality of nose portions, each of which is received within an open end of a different section of track. Each nose portion has electrical contacts in electrical communication with corresponding electrical contacts of the other nose portions so as to conductively connect each track section to adjacent track sections. Unlike the feed, the connector is not connected directly to an electrical junction box. Instead one of the track sections is powered, such as by a feed connector at its opposite end, and the connector conductively connects the powered track section to one or more unpowered track sections.

Connectors used to mechanically and electrically connect adjacent track sections can come in a variety of configurations: a straight connector for connecting two adjacent collinear track sections; an L-shaped connector for connecting two track sections disposed at right angles; a T-shaped or Y-shaped connectors for joining three track sections; X-shaped connectors for connecting four track sections; and flexible connectors which can be bent to joint two adjacent track sections at virtually desired angle.

As used herein, the term "connector" will be understood to mean any device which mechanically couples to one or more track sections of a track lighting system and either electrically connects one or more track sections to a source of electrical power or electrically connects two or more track sections to one another.

A problem with prior art connectors for track lighting systems concerns the integrity of the mechanical connection between the connector and the track section(s). Heretofore connectors have generally relied only upon the interference fit between the nose section of the connector and the interior walls of the hollow track section. Since the track sections and the connectors are supposed to be stationary once mounted to the support surface, this type of mechanical connection should in theory be adequate. In practice, however, the relatively heavy (e.g., twelve gauge) electrical wires required by many electrical codes tend to be somewhat stiff. Thus, after the installer makes the electrical connections to the connector and tries to stuff the excess wire back up through the hole in the support surface, the wire can exert a force which tends to push the connector away from the support surface. The same effect is sometimes achieved even after a proper initial installation by later workers relocating the wire in the course of installing other infrastructure, such as plumbing or ventilation ducts, or by making later electrical repairs. The forces exerted by the stiff wire can result in a connector which bends at an angle with respect to the track and leaves an unsightly gap between the connector and the support surface.

This problem also exists in so-called "pendant-hung" track lighting installations, where the track is not mounted directly against the ceiling but instead is suspended below the ceiling by a plurality of vertical stems. Typically an electrical conduit runs vertically along one of the stems and then makes a 90° turn to run along the top of the track. The conduit then makes another 90° turn to connect to a socket inside the connector. In this type of installation forces are exerted against the connector not only by the heavy gauge electrical wire but also by the conduit's resistance to turns.

Thus there is a need for a connector for track lighting systems which provides an improved physical connection between the connector and an associated track section.

There is a further need for a connector for track lighting systems which will help prevent the connector from being bent at an angle with respect to an associated track section by forces exerted by electrical wiring.

A further problem is associated with prior art connectors for track lighting systems wherein the connectors are grounded to the track extrusion. To accomplish this ground connection a ground contact extends laterally from the nose portion of the connector to contact a rib of the track. The ground contact is constructed from copper, brass, or other suitable conductive material and is typically spring-loaded to ensure good electrical coupling between the contact and the rib of the track. Providing the connector with a spring-loaded ground contact increases the cost and complexity of the manufacturing process. Similarly, providing the track with a special rib whose sole purpose is to provide a structure for engaging the ground contact of the connector adds to the complexity and cost of the track.

Thus there is a need for a connector for track lighting systems which eliminates the need for a spring-loaded ground contact.

There is a further need for a connector for track lighting systems which eliminates the need for a special structure on the track to which the ground contact can electrically couple.

SUMMARY OF THE INVENTION

Stated generally, the present invention overcomes these and other problems associated with prior art connectors for track lighting systems. The connector provides an enhanced physical connection between the connector and an associated track section and helps to prevent the connector from being bent at an angle with respect to an associated track section by forces exerted by electrical wiring. The connector thus remains flat against the ceiling and thus does not create any unsightly gaps between the connector and the underlying support surface. In pendant-hung systems, the connector remains aligned with the adjoining track section and is not easily forced out of alignment.

Stated somewhat more specifically, the present invention comprises a track lighting system in which a light fixture is physically and electrically connected to a track. The track is elongated and defines a central longitudinal passageway. A voltage bus, a neutral bus, and a grounding element are disposed within the central longitudinal passageway. Means disposed above the central longitudinal passageway define a pair of opposing channels. The track lighting system further includes a connector which comprises a housing and a flange extending from the housing. The flange is received within an end of the central longitudinal passageway of the track by way of an interference fit, and the flange has electrical contacts for engaging the voltage bus, the neutral bus, and the grounding element disposed within the central longitudinal passageway. The connector further includes a tongue extending from the housing spaced apart from and generally parallel to the flange and having edge portions which engage the opposing channels of the track in an interference fit. The engagement between the tongue and the channels of the track enhances the physical connection between the connector and the track.

In one embodiment the connector is a terminal or feed connector which is connected by electrical wires to an electrical service panel. The connector thus supplies the track with electrical power.

In other embodiments the connector comprises two or more flanges and associated tongues for engaging two or more track sections to physically and conductively couple the track sections. In each case the engagement between the tongues of the connector and the channels of the respective track sections enhances the connection between the connector and the track.

Thus it is an object of the present invention to provide an improved connector for track lighting systems.

It is another object of the present invention to provide an improved connector for track lighting systems which provides a stronger physical connection between the connector and an associated track section.

It is another object of the present invention to provide an improved connector for track lighting systems which will lie flat against the underlying support surface and resist being forced away from the support surface by forces exerted by stiff electrical wiring.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
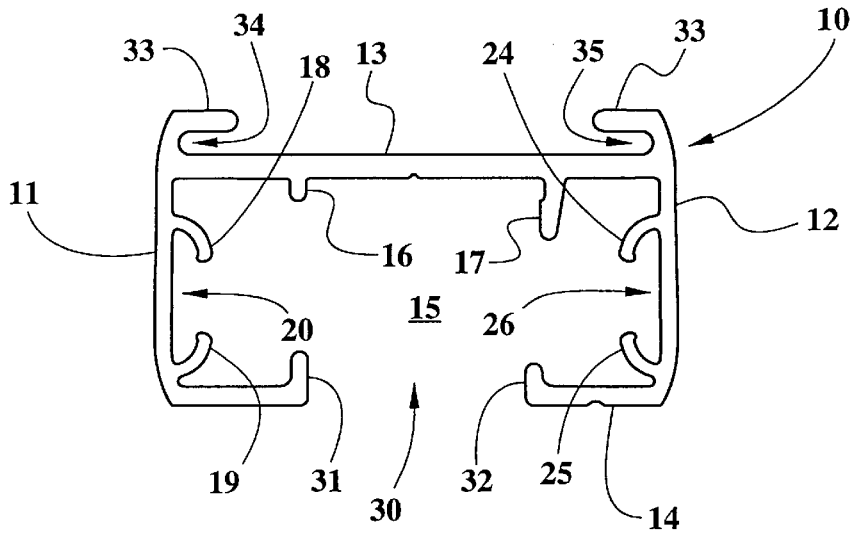
FIG. 1 is an end view of a track section of a track lighting system according to the present invention.
Figure 2:
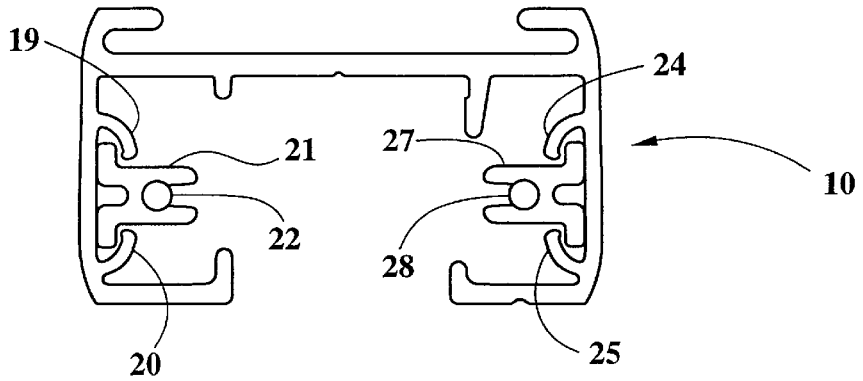
FIG. 2 is an end view of the track section of FIG. 1 with electrical buses installed.
Figure 3:
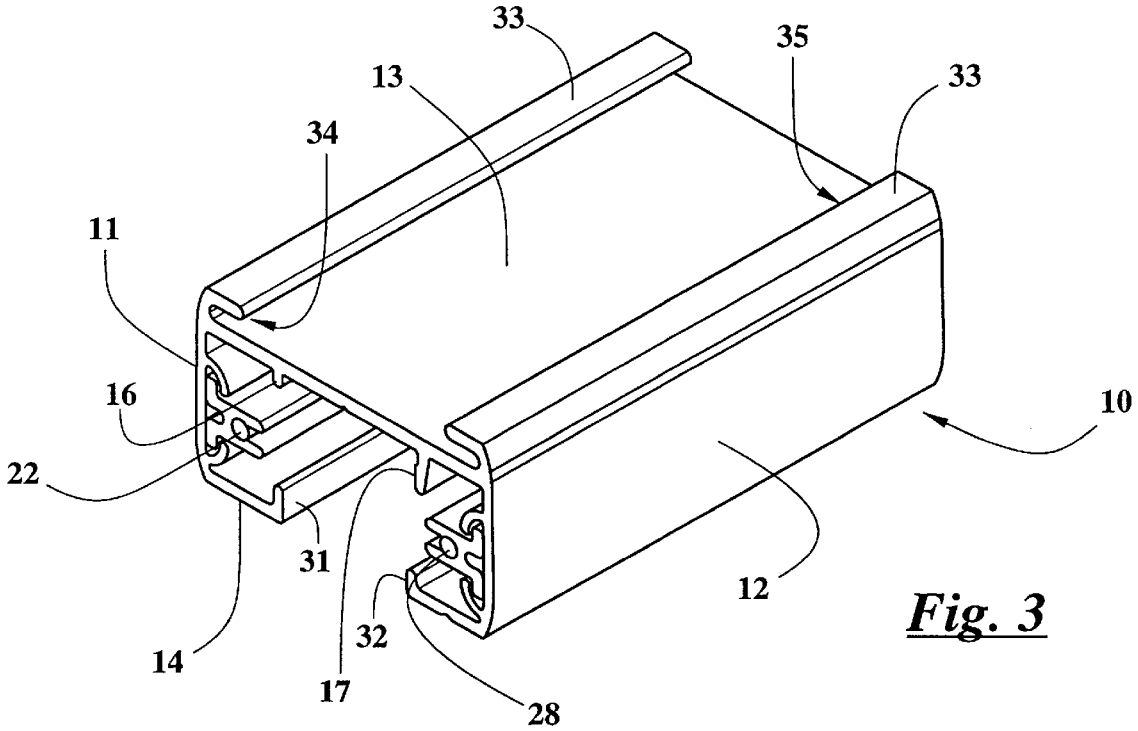
FIG. 3 is a perspective view of the track section and electrical buses of FIG. 2.
Figure 4:
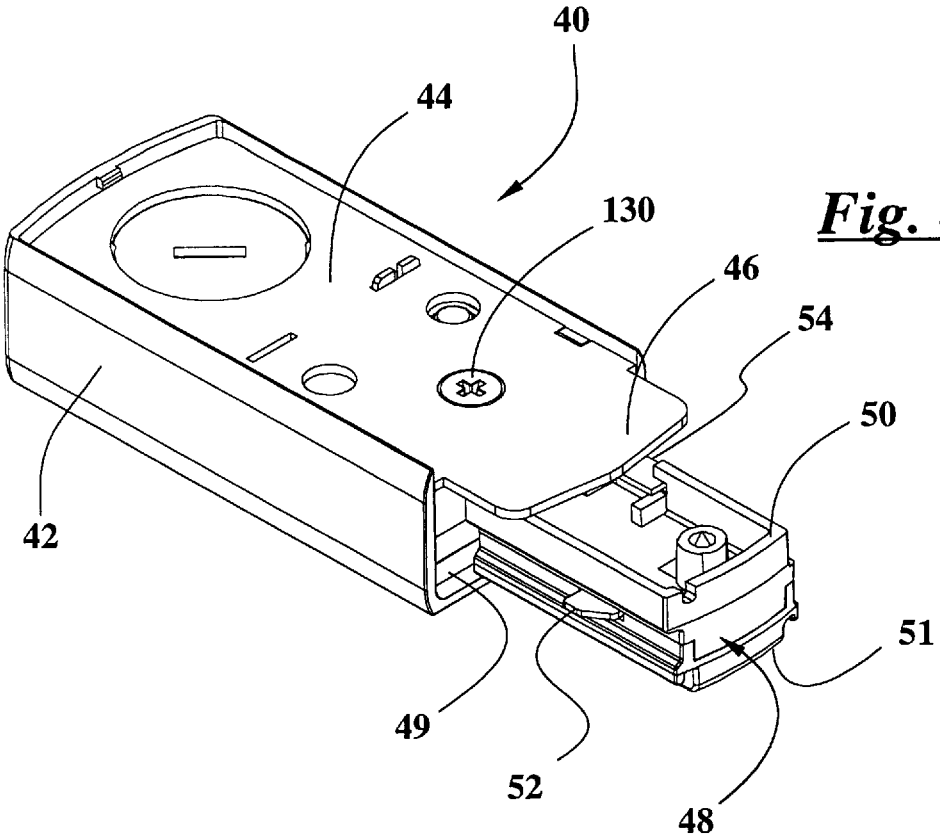
FIG. 4 is a top perspective view of a first embodiment of a connector according to the present invention.
Figure 5:
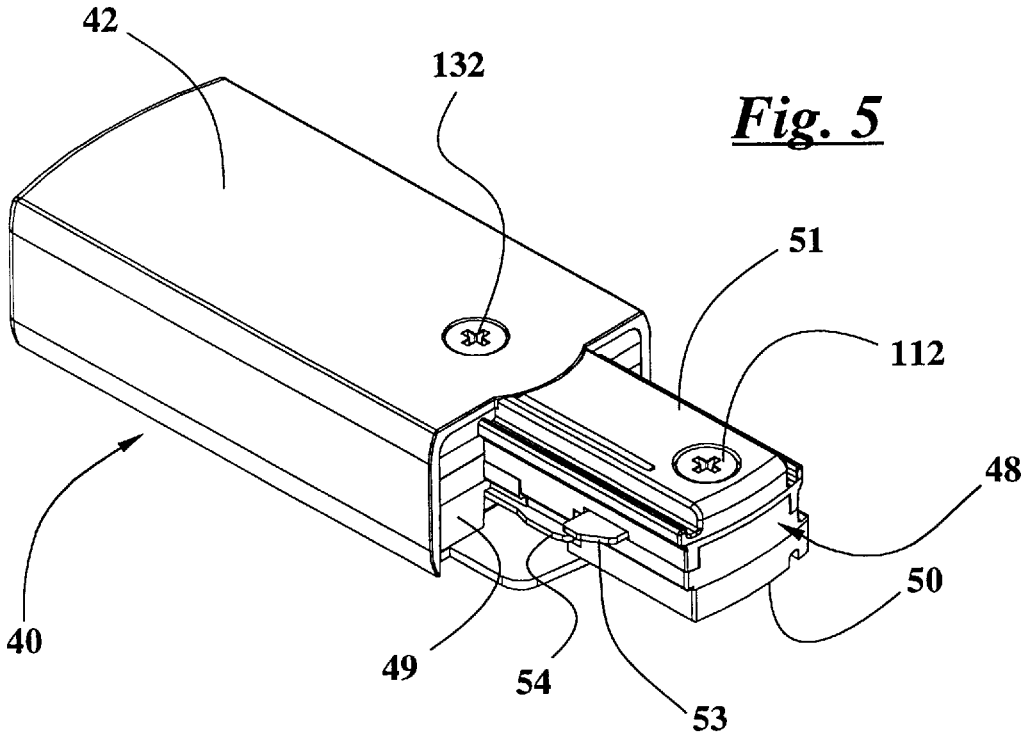
FIG. 5 is a bottom perspective view of the connector of FIG. 4.
Figure 6:
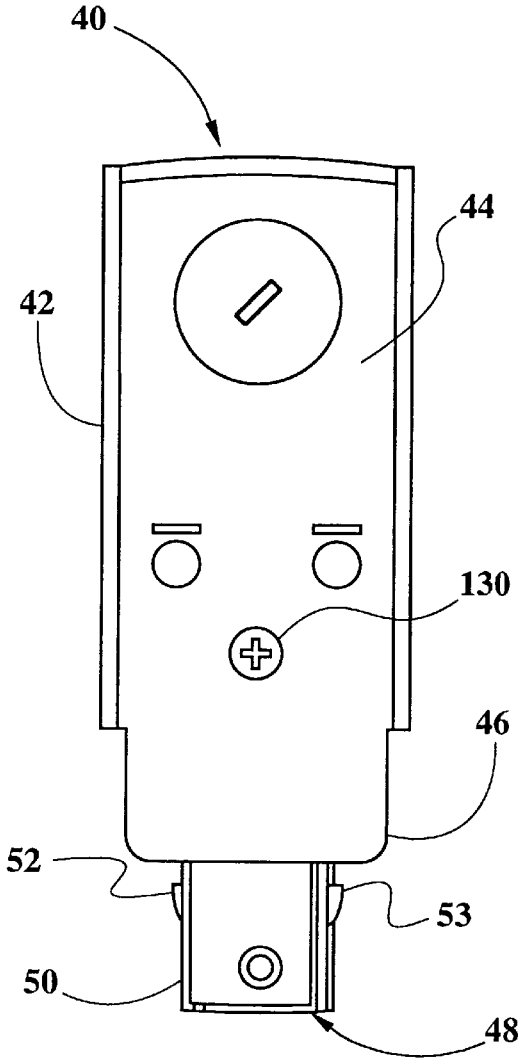
FIG. 6 is a top view of the connector of FIG. 4.
Figure 7:
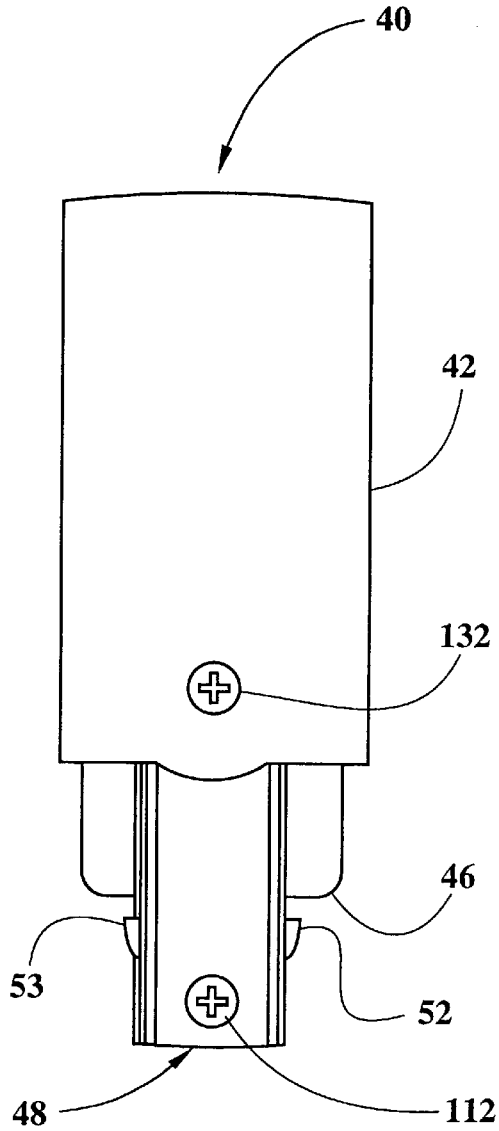
FIG. 7 is a bottom view of the connector of FIG. 4.
Figure 8:
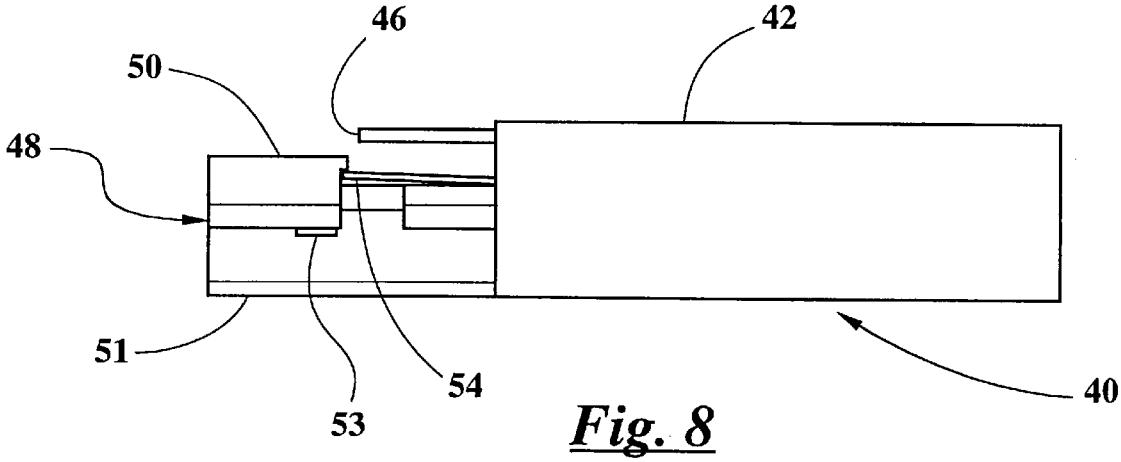
FIG. 8 is a side view of the connector of FIG. 4.

Referring now to the drawings, in which like numerals indicate like elements throughout the several views, FIGS. 1–3 illustrate a track section 10 of a track lighting system. The track 10 is a hollow, elongated extrusion of indeterminate length formed from aluminum or other suitable material. The track 10 has first and second side walls 11, 12, a top wall 13, and a bottom wall 14 defining a central passageway 15. A short vertical locating rib 16 is located within the central passageway 15 and extends downward from the bottom face of the top wall 13. A grounding rib 17, slightly longer than the locating rib 16, extends downward from the bottom face of the top wall 13 in spaced apart relation to the locating rib.

Brackets 18, 19 define a pocket 20 on the interior face of the first side wall 11. As seen in FIGS. 2 and 3, an insulating element 21 resides within the pocket 20. A voltage bus 22 is carried by the insulating element 21. Brackets 24, 25 define a pocket 26 on the interior face of the opposite side wall 12. An insulating element 27 resides within the pocket 26. A neutral bus 28 is carried by the insulating element 27.

A channel 30 is formed in the bottom wall 14. First and second vertical channel walls 31, 32 extend upward from the bottom wall 14. The first vertical channel wall 31 is taller than the second vertical channel wall 32.

In the conventional manner which will be readily understood by those skilled in the art, a track adapter (not shown) slidably mounts to the bottom of the track 10 and provides a mechanical and electrical interface between the track and a lighting fixture (also not shown). A portion of the adapter engages the channel 30 in the bottom of the track 10 to couple the adapter and an associated light fixture to the track. Electrical contacts on the adapter engage the grounding rib 17, the voltage bus 22, and the neutral bus 28 to provide electrical power to the lighting fixture.

It will be understood that the internal configuration of the track 10 is disclosed only by way of example and that the present invention contemplates other possible variations. For example, the track 10 might carry a third insulating element supporting a ground bus, instead of the grounding rib 17. Or the track 10 might support a pair of voltage busses such that an adapter can be configured to conductively engage either of two separate circuits.

The side walls 11, 12 of the track 10 extend above the top wall 13. An inwardly extending lip 33 is formed at the upper end of each side wall 11, 12 to define a pair of mutually opposed channels 34, 35.

Referring now to FIGS. 4–8, a connector 40 comprises a housing 42 whose exterior walls in cross section match the exterior walls of the track 10. A base plate 44 is located on top of the housing 42. A section of the base plate 44 extends forward of the front end 45 of the housing 42 to form a tongue 46. Beneath the tongue a flange 48 extends forward from the front end 45 of the housing 42. The flange 48 includes a trim panel 49, a contact retaining portion 50, and a bottom cover 51. The flange 48 is configured to fit within the longitudinal passageway 15 of the track section 10 in an interference fit to couple the connector 40 physically to the track section. In addition, the flange 48 carries electrical contacts for electrically coupling the connector 40 to the track section 10. More specifically, a voltage contact 52, a neutral contact 53, and a ground contact 54 are located on lateral edges of the flange 48 and are disposed to engage the voltage bus 22, the neutral bus 28, and the grounding rib 17 of the track section 10.

Figure 9:
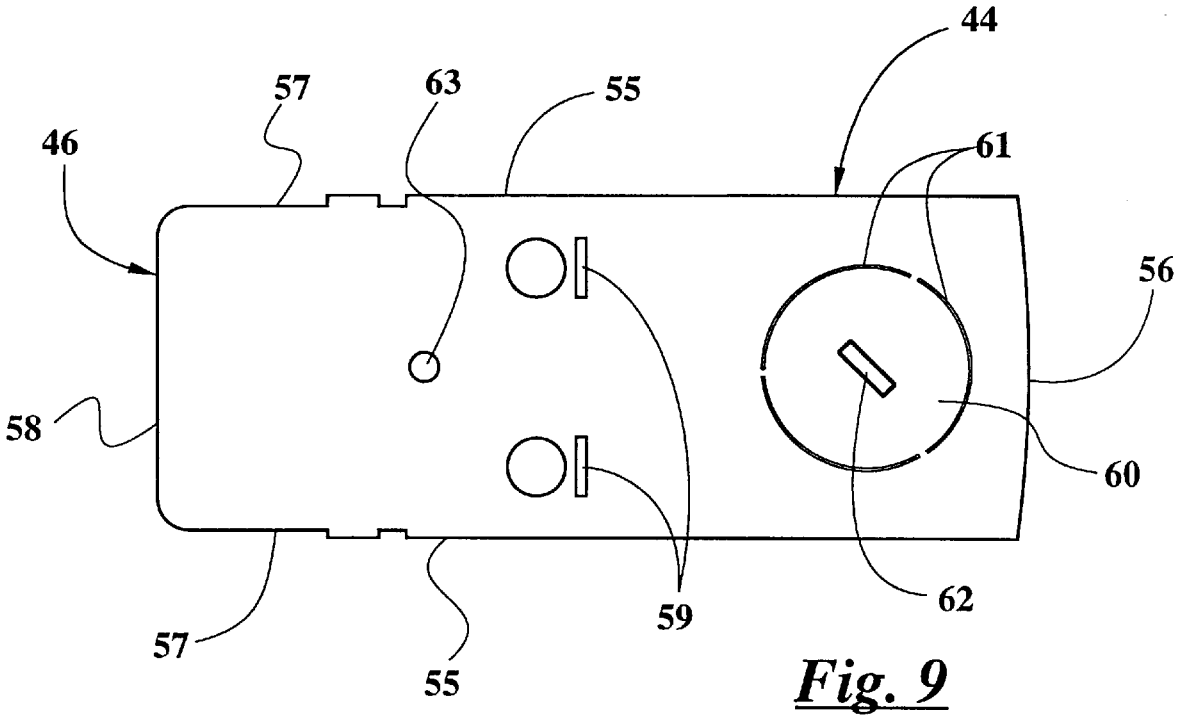
FIG. 9 is a top view of a base plate of the connector of FIG. 4.

Referring now to FIG. 9, the base plate 44 includes longitudinal edges 55 and a rear edge 56. The tongue 46 of the base plate 44 includes lateral edges 57 and a forward edge 58. A pair of slots 59 are formed in a central portion of the base plate 44. A circular knockout 60 is defined in the base plate 44 by slots 61 and has a screwdriver slot 62 in its central portion. The knockout 60 can be easily removed from the base plate by inserting a screwdriver in a slot 62 and turning. A circular bore 63 is formed in the central portion of the base plate 44.

Figure 10:
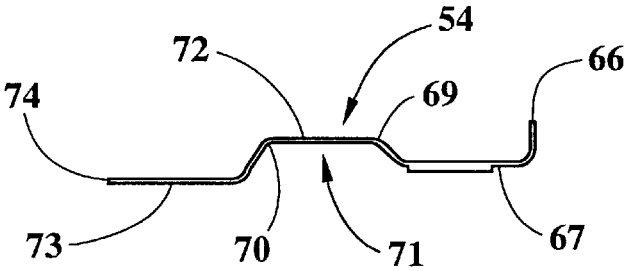
FIG. 10 is a side view of a ground contact of the connector of FIG. 4.
Figure 11:
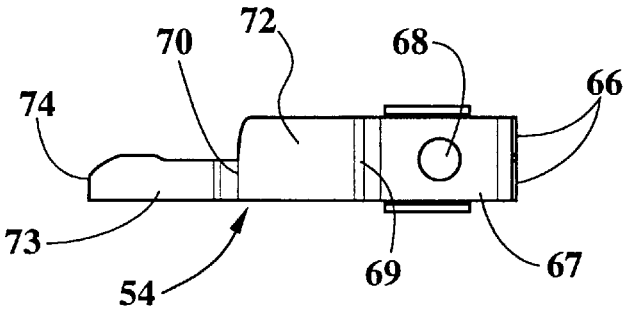
FIG. 11 is a top view of the ground connector of FIG. 10.

FIGS. 10 and 11 show the ground contact 54. The ground contact 54 is comprised of copper, brass, or other suitable conductive material and includes a pair of upstanding locator tabs 66 at its rearward end. A head portion 67 formed in the ground contact just forward of the locator tab 66 includes a threaded bore 68. The ground contact bends up at 69 and down at 70 to form a recess 71 in its lower face and a bearing surface 72 on its upper face. A blade portion 73 narrower than the head portion 67 extends forward from the bend 70 and terminates at a forward end 74.

Figure 12:
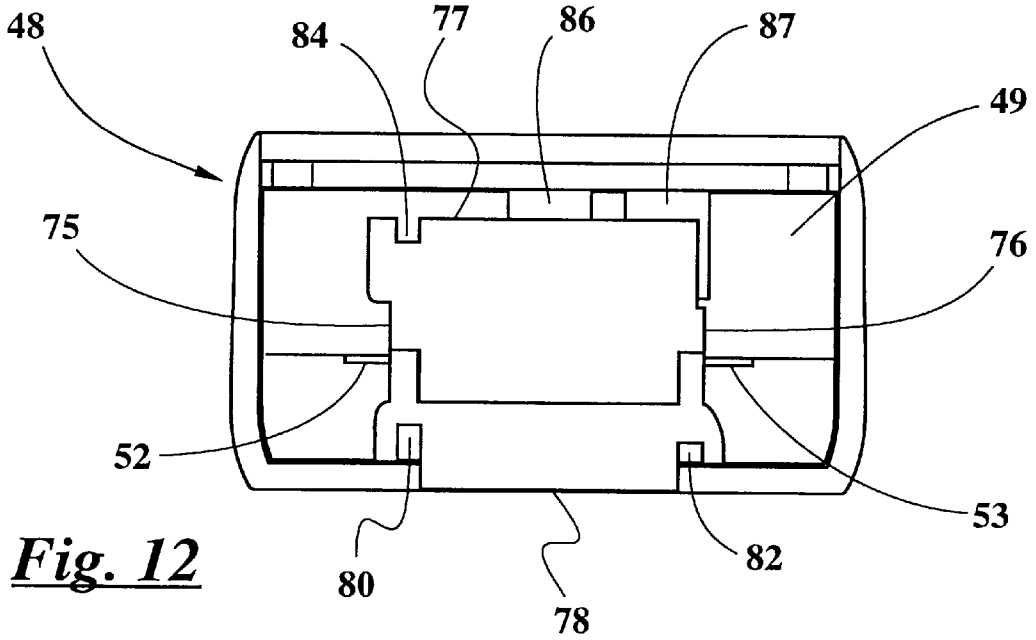
FIG. 12 is an end view of the connector of FIG. 4.

Referring now to FIG. 12, the flange 48 has opposed lateral surfaces 75, 76, a top wall 77, and a bottom wall 78. A deep channel 80 is formed in the bottom wall 78 adjacent one lateral edge, and a shallow channel 82 is formed in the bottom wall adjacent the opposite lateral edge. A channel 84 is formed in the top wall 77 of the flange 48 adjacent one longitudinal edge. A pair of rectangular openings 86, 87 are formed in the upper edge of the trim panel 49 of the flange 48.

Figure 13:
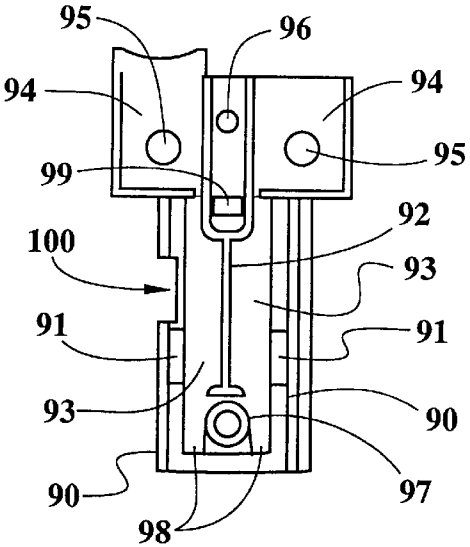
FIG. 13 is a bottom view of a contact-retaining portion of the flange of the connector of FIG. 4.
Figure 14:
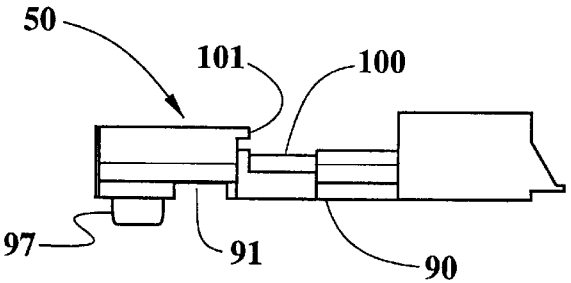
FIG. 14 is a side view of the contact-retaining portion of FIG. 13.

Referring now to FIGS. 13 and 14, the contact-retaining portion 50 of the flange 48 is depicted. The contact retaining portion 50 is a generally hollow shell having side walls 90. Apertures 91 are formed in the side walls 90. A central dividing wall 92 separates the shell into two elongated cavities 93. Each cavity 93 includes a generally square enlargement 94 adjacent its rearward end. Smooth bores 95 are formed in the center of the enlargements 94. A threaded bore 96 is formed between the two enlargements 94. A screw boss 97 is formed between the two cavities 93 adjacent their forward ends, creating narrow grooves 98 at the forward ends of the cavities. A rectangular opening 99 is formed in the contact retaining portion 50 between the cavities 93 and adjacent the enlargements 94. A generally rectangular opening 100 is formed in the side wall 90. As can be seen in FIG. 14, a lip 101 extends rearward over a portion of the rectangular opening 100.

Figure 15:
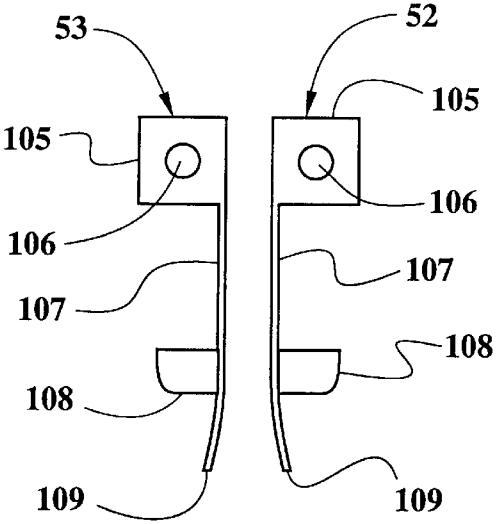
FIG. 15 is a top view of a neutral contact and a voltage contact of the connector of FIG. 4.

The voltage and neutral contacts 52, 53 are shown in FIG. 15. The contacts 52, 53 are mirror images of one another. Each contact has a square head portion 105 having a threaded circular bore 106 formed therein. A cantilevered arm 107 extends forward from the head portion 105. A tab 108 extends laterally from each cantilevered arm 107 at a location adjacent to, but spaced apart from, the forward end 109 of the arm.

Figure 16:
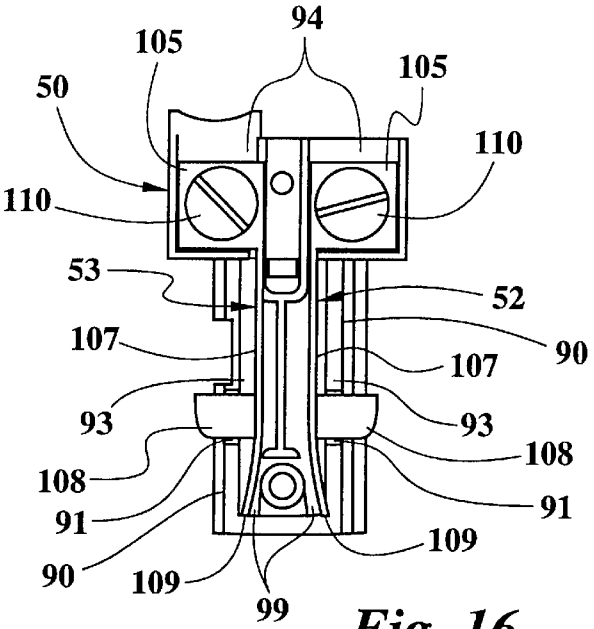
FIG. 16 is a cross sectional view of the contact-retaining portion of FIG. 13 showing the contacts of FIG. 15 installed.

FIG. 16 shows the voltage and neutral contacts 52, 53 mounted within the contact retaining portion 50 of the flange 48. The heads 105 of the contacts 52, 53 are received within the square enlargements 94 of the contact retaining portion 50. The shank of a screw 110 is threaded into the bore 106 in the head 105 of each contact 52, 53. The underlying smooth bore 106 in the enlargement 94 of the contact-retaining portion 50 provides clearance for the tip of the screw. Electrical wires (not shown) can be connected to the contacts 52, 53 by clamping them beneath the heads of the screws 110.

The cantilevered arms 107 of the contacts 52, 53 extend forward within the elongated cavities 93, with the forward ends 109 of the cantilevered arms being captured within the narrow grooves 99 at the forward ends of the cavities. The laterally-extending tabs 108 of the contacts 52, 53 extend through the apertures 91 in the side walls 90. As can be seen, the cantilevered arms 107 have sufficient space within the cavities 93 to deflect laterally in response to an inward pressure exerted against the tabs 108, while the arms and tabs will spring back to their original positions once the force is removed.

Figure 17:
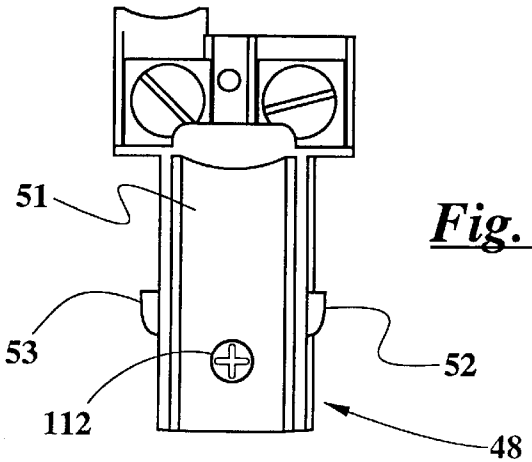
FIG. 17 is a bottom view of the flange of the connector of FIG. 4.

Referring now to FIG. 17, with the voltage and neutral contacts 52, 53 thus mounted within the contact retaining portion 50, the bottom cover 51 of the flange 48 is mounted to the lower end of the contact retaining portion. The bottom cover has apertures in its upper wall to clear the tabs 108 of the contacts 52, 53. A screw 112 inserted through a hole in the bottom cover 51 and threaded into the screw boss 97 (FIG. 13) in the contact retaining portion 50 maintains the bottom cover in position.

Figure 18:
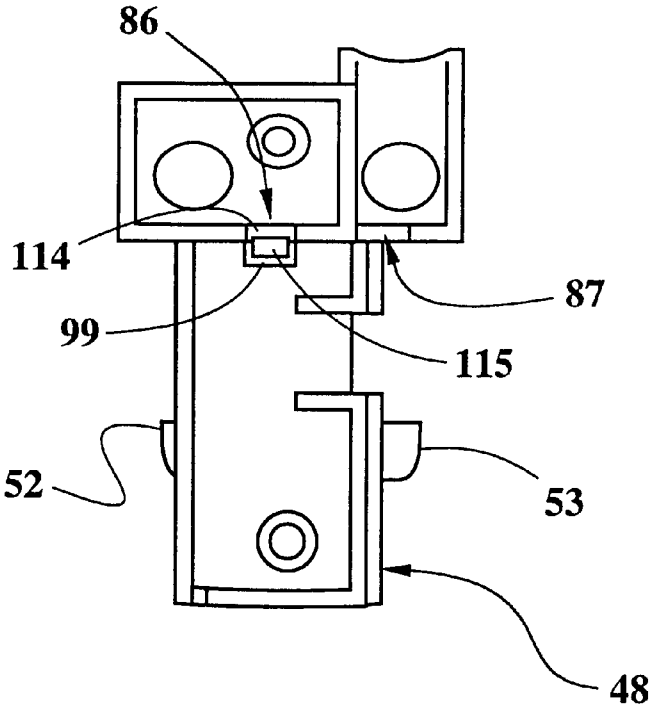
FIG. 18 is a top view of the assembled flange of FIG. 17.

FIG. 18 is a top view of the assembled flange 48 showing the voltage and neutral contacts 52, 53 extending laterally from the flange. The rectangular openings 86, 87 in the upper edge of the trim plate 49 are also visible in FIG. 18. The rectangular opening 86 has a bottom wall 114. A hook 115 projecting upward from the bottom cover 51 extends through the rectangular opening 99 in the contact retaining portion 50 and snaps over the bottom wall 114 of the rectangular opening 86 to further secure the bottom cover to the contact-retaining portion 50. A pair of upstanding bosses 116 are coaxially aligned with the holes 95 (FIG. 13) in the contact retaining portion.

Figure 19:
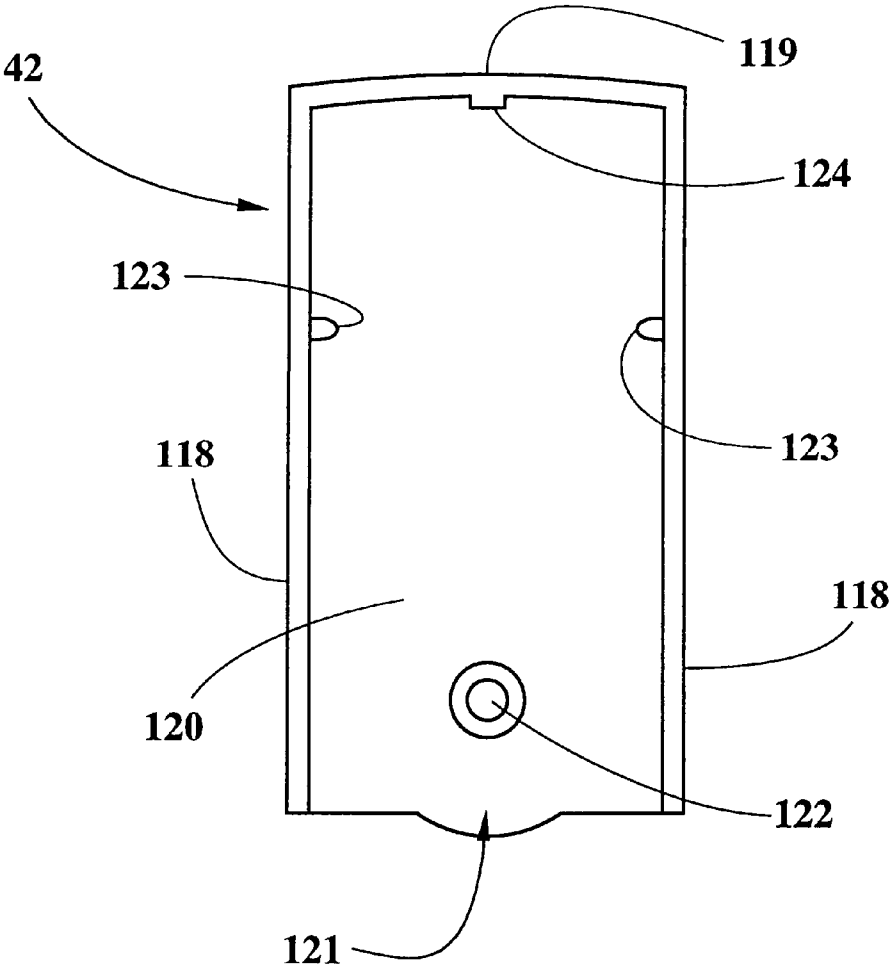
FIG. 19 is a top view of the housing of the connector of FIG. 4.

FIG. 19 is a top view of the housing 42. The housing 42 is a generally hollow shell having upstanding side walls 118, a back wall 119, a bottom wall 120, and an open forward end 121. A smooth bore 122 is formed in the bottom wall 120 of the housing 42. Vertical support ribs 123 are formed along the inner face of each of the side walls 120 of the housing 42. A retaining tab 124 is formed at the upper edge of the back wall 121 of the housing 42. When the base plate 44 is mounted to the housing 42, the longitudinal edges 55 of the lower surface of the base plate rest on the support ribs 123, and the rear edge 56 of the base plate fits underneath the retaining tab 124.

Figure 20:
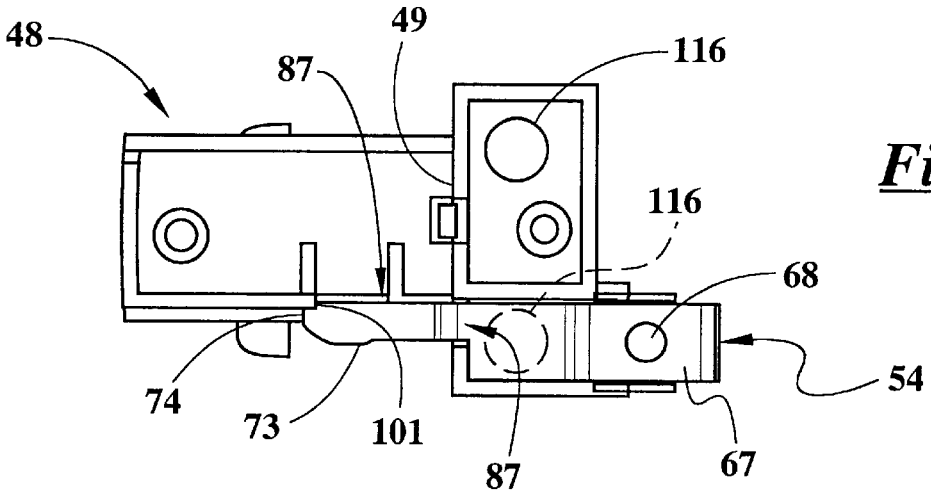
FIG. 20 is a top view showing the assembly of the ground contact of FIG. 10 being assembled onto the flange of FIG. 17.
Figure 21:
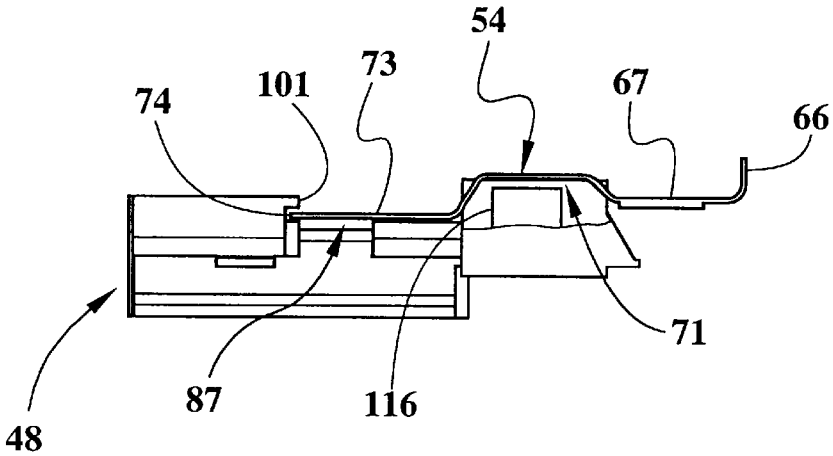
FIG. 21 is a side view of the assembly of FIG. 20 with the side wall of the flange being partially broken away to reveal interior detail.

Assembly of the flange 48, ground contact 54, and base plate 44 will now be explained with reference to FIGS. 20–22. The ground contact 54 is laid on top of the flange 48, as shown in FIGS. 20 and 21, with the blade portion 73 being received within the rectangular window 87 in the upper edge of the trim plate 49. The forward end 74 of the blade portion 73 fits beneath the lip 101. The recess 71 in the lower surface of the ground contact 54 clears the upstanding boss 116. The head portion 67 of the neutral contact 54 is located rearward of the rear edge of the flange 48.

Figure 22:
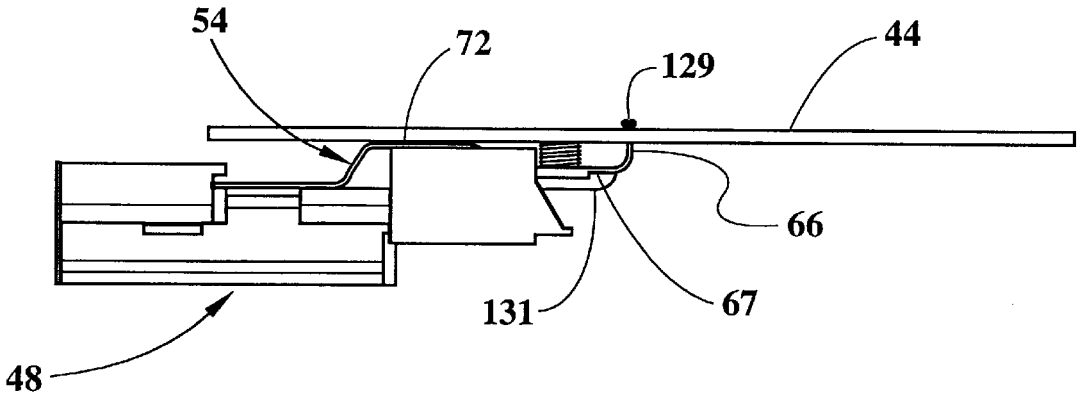
FIG. 22 is a side view showing the assembly of the ground contact and flange of FIG. 20 onto the base plate of FIG. 9.

The base plate 44 is then assembled onto the flange 48, as shown in FIG. 22, with the bearing surface 72 of the ground contact 54 bearing against the lower surface of the base plate 44. The locator tabs 66 of the ground contact 54 are received within one of the slots 59 (FIG. 9) in the base plate 44. The portions of the locator tabs 66 extending above the base plate 44 are then crimped at 129 to effect a secure connection between the ground contact 54 and the base plate. To hold the flange 48 to the base plate 44 a screw 130 (see, e.g., FIGS. 4 and 6) is inserted through the bore 63 (FIG. 9) in the base plate and threaded into the threaded bore 96 (FIG. 13) in the flange.

With the flange 48 and ground contact 54 thus mounted to the base plate 44, the threaded shank of a screw 131 is inserted into the threaded bore 68 (FIG. 20) in the head portion 67 of the ground contact 54. An electrical wire (not shown) can be attached to the ground contact 54 by clamping the end of the wire between the head of the screw 131 and the head portion 67 of the ground contact.

Figure 23:
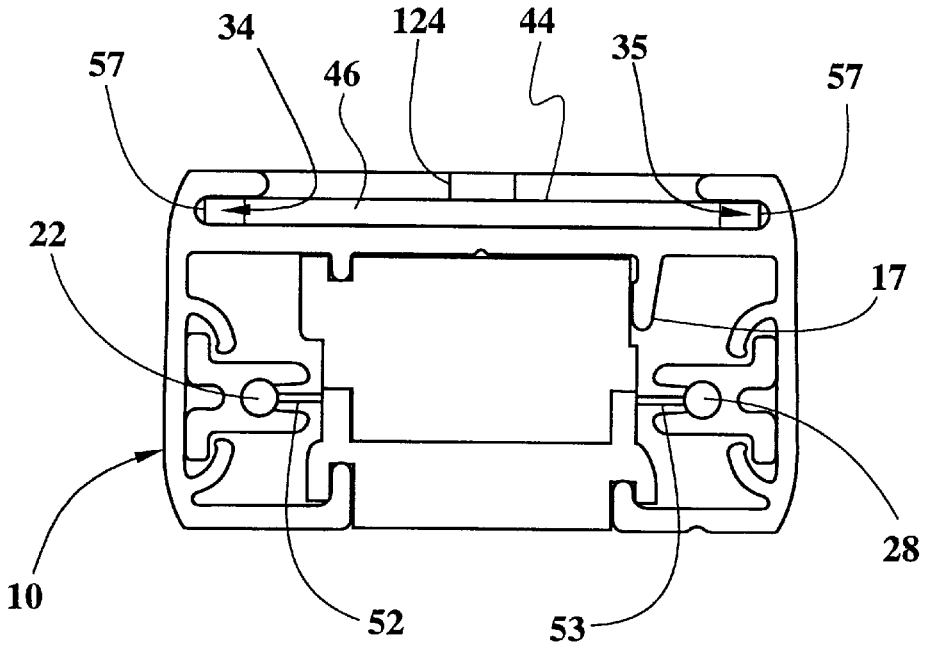
FIG. 23 is a perspective view of the track and connector showing the connector about to be coupled to the end of the track.

FIG. 23 illustrates the assembly of the flange 48 and base plate 44 onto the end of a section of track 10. The tract 10 and the flange and base plate assembly are aligned relative to one another such that the locating rib 16 on the top wall 13 of the track is aligned with the channel 84 in the top wall 77 of the flange 48, the tall channel wall 31 at the bottom of the track is aligned with the deep channel 80 in the bottom wall 78 of the flange, and the short channel wall 32 of the track is aligned with the shallow channel 82 in the bottom wall of the flange. Because the track 10 and the flange 48 are asymmetrical, the flange can be inserted into only one end of the track, thus assuring that the voltage contact 52 of the connector will always engage the voltage bus 22 of the track, and the neutral contact 53 of the flange will always engage the neutral bus 28 of the track.

As the flange 48 is inserted into the end of the track 10, the lateral edges 57 of the tongue 46 at the forward end of the base plate 44 engage the channels 34, 35 defined by the upper ends of the side walls 11, 12 of the track in a snug interference fit. The assembled track 10 and flange/base plate assembly are shown in FIG. 24.

The physical connection between the track 10 and the flange/base plate assembly thus does not rely exclusively on the interference fit between the flange 48 and the track but instead is reinforced by the interference fit between the tongue 46 of the base plate 44 and the channels 34, 35 of the track.

When the connector and track have been assembled and mounted, the housing 42 is then mounted to the assembled flange 48 and base plate 44. The open forward end 121 of the housing 42 fits over the trim plate 49 of the flange 48. A screw 132 (see, e.g., FIGS. 5 and 7) is inserted through the smooth bore 122 in the bottom wall 120 of the housing 42 and threaded into the bore 96 in the contact retaining portion 50 (FIG. 14) to secure the flange 48 to the housing.

Figures 24, 25:
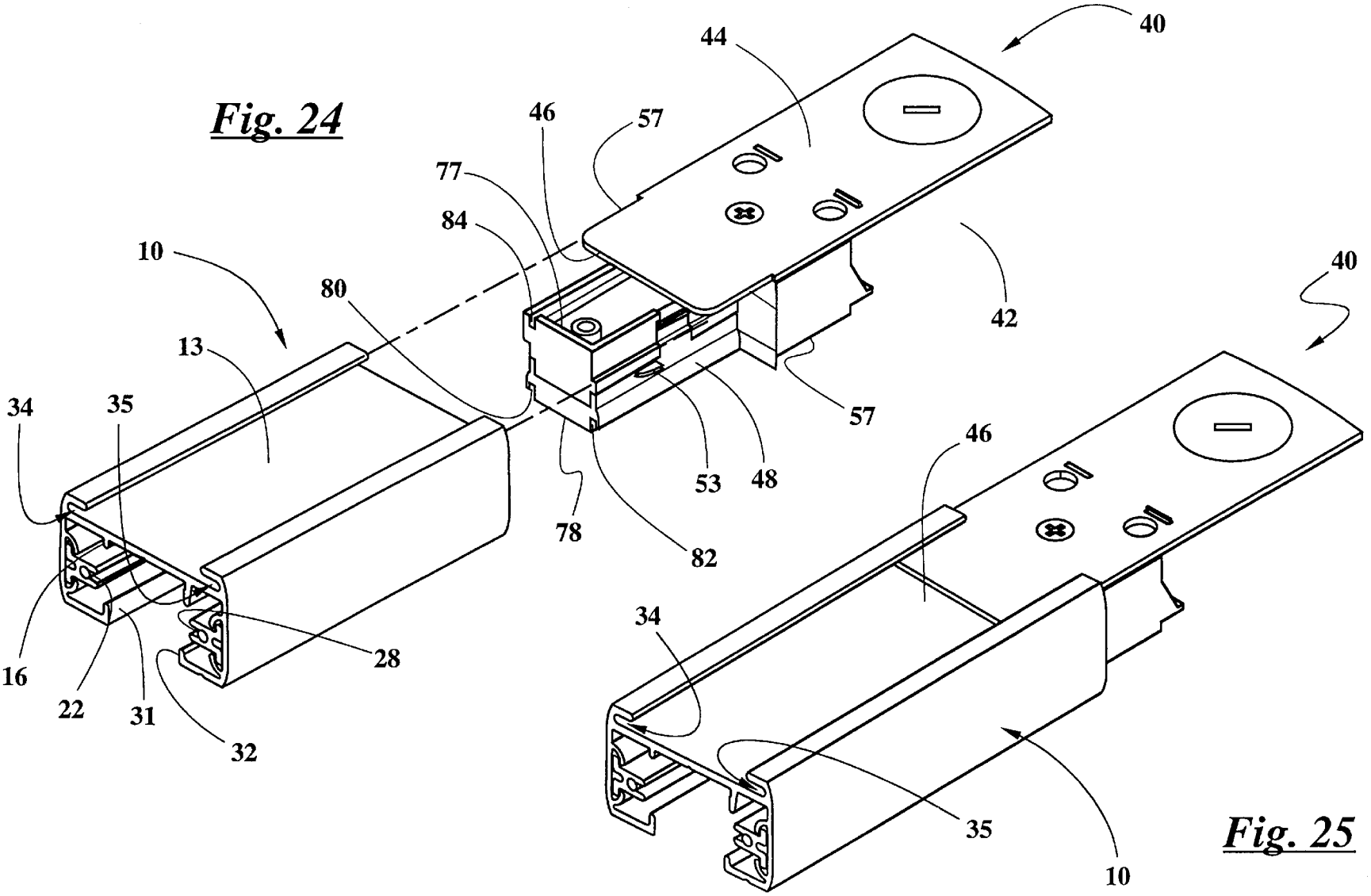
FIG. 24 is a perspective view of the assembled connector and track of FIG. 23.
FIG. 25 is an end view of the track and connector assembly of FIG. 24.

FIG. 25 is an end view of the assembled track and connector. The voltage contact 52 of the connector 40 engages the voltage bus 22 of the track 10, and the neutral contact 53 of the connector engages the neutral bus 28 of the track. Also, while hidden from view in FIG. 25, the ground contact 54 of the flange engages the grounding rib 17 of the track.

FIG. 25 also shows the engagement of the lateral edges 57 of the tongue 46 engage the channels 34, 35 in the top of the track. Further illustrated in FIG. 25 is the manner in which the base plate 44 fits underneath the retention tab 124 of the housing 42.

The connector 40 hereinabove described connects to only a single section of track 10 and is adapted to serve as an interface between the track and electrical wires connected to an electrical panel. However, as will now be shown, the same principles can be applied to connectors adapted to engage two or more sections of track 10.

FIGS. 24 and 25 illustrate a straight connector 140 according to a second disclosed embodiment. The connector 140 comprises a housing 142 which is open at both ends. Two flanges 48, 48*a* are collinearly disposed and project from opposite ends of the housing 142. The flange 48*a* is the mirror image of the flange 48. A base plate 144 includes tongues 46 at both ends. Thus when the connector 140 connects between two sections of track 10, the connections at both ends are accomplished by both a flange 48 or 48*a* engaging the longitudinal passageway 15 of the track 10 and by a tongue 46 engaging the channels 34, 35 at the upper end of the track.

In the connector 140, the voltage, neutral, and ground contacts of the flange 48 are in conductive communication with the corresponding voltage, neutral, and ground contacts of the other flange 48*a*. Thus the connector 140 conductively connects the voltage bus 22 and the neutral bus 28 of one section of track 10 with the corresponding voltage and neutral busses of the other section of track and conductively connects the grounding ribs 17 of the respective track sections.

If one of the sections of track 10 is otherwise connected to a source of electrical power, such as by a connector 40 at its opposite end, then the connector 140 can be used to passively connect the powered track section to the other track section. In the alternative, by removing a knockout 160 in the base plate 144, electrical wires from an electrical service panel can be connected to the connector 140 to power both track sections.

Figures 26, 27:
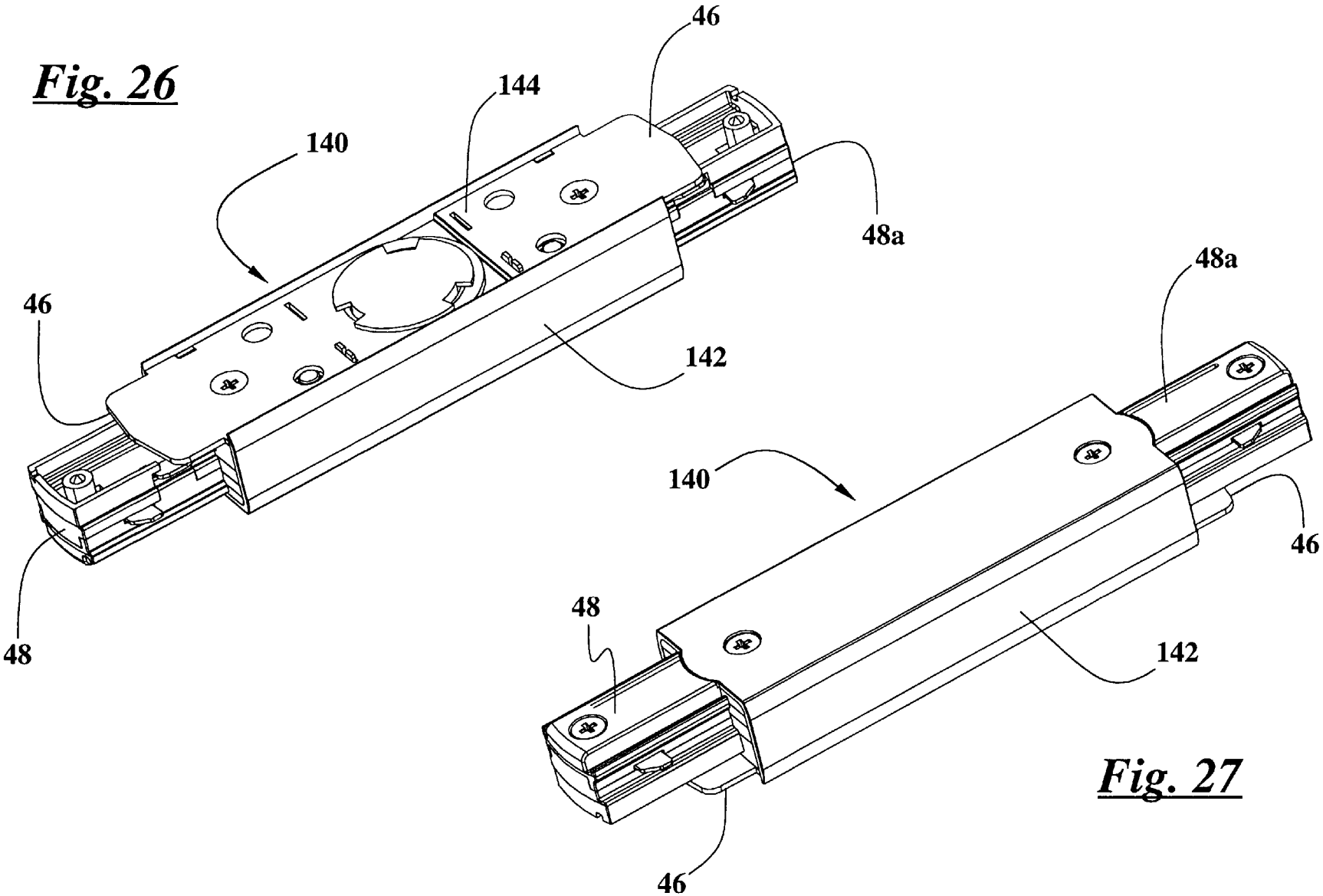
FIG. 26 is a top perspective view of a second embodiment of a connector according to the present invention, being adapted to connect two adjacent collinear track sections.
FIG. 27 is a bottom perspective view of the connector of FIG. 26.

A third embodiment of a connector 240 is shown in FIGS. 26 and 27. Like the connector 140, the connector 240 includes two flanges 48, 48*a* and two tongues 46 for interconnecting two sections of track 10. However, in the connector 240, the flanges 48, 48*a* are disposed at right angles to one another for connecting perpendicular track sections. As is the case with the connector 140, the physical connections to both track sections are accomplished by both the flange 48 or 48*a* engaging the longitudinal passageway 15 in the track 10 and by the corresponding tongue 46 engaging the opposing channels 34, 35 at the upper end of the track.

Figure 29:
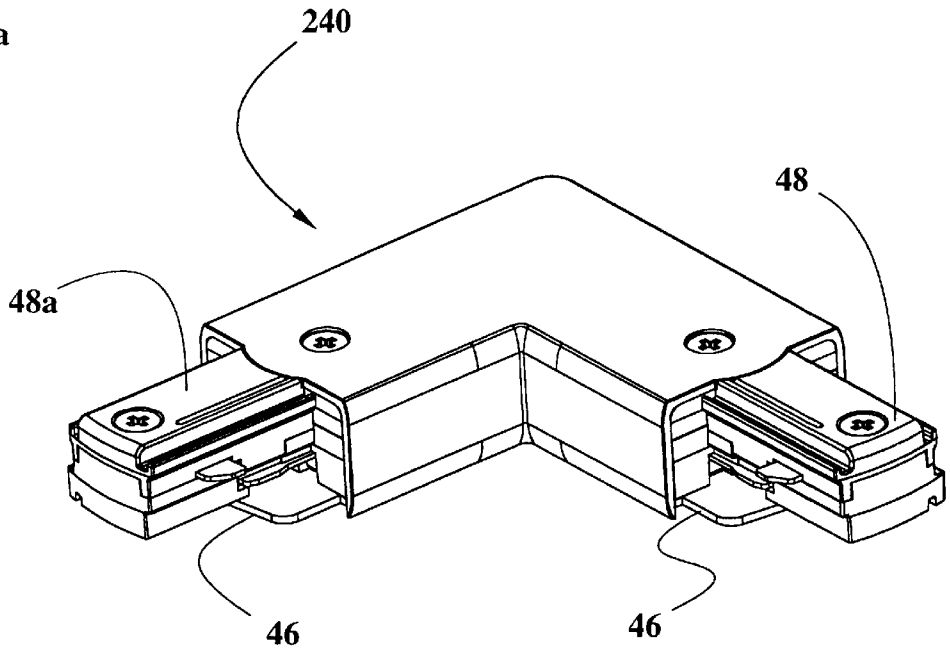
FIG. 29 is a bottom perspective view of the connector of FIG. 28.
Figure 28:
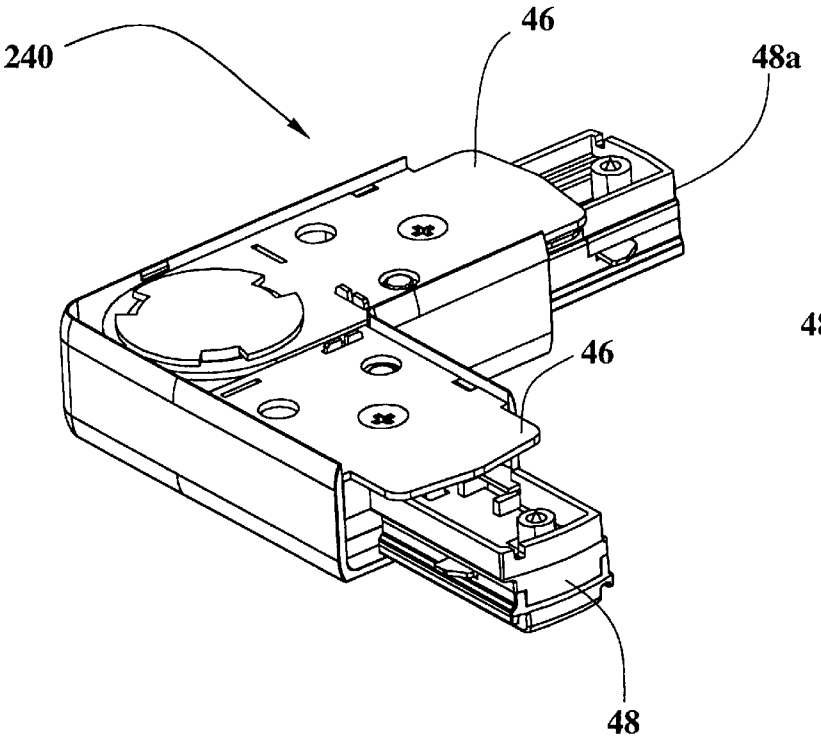
FIG. 28 is a top perspective view of a third embodiment of a connector according to the present invention, being adapted to connect two adjacent perpendicular track sections.

FIGS. 28 and 29 illustrate a fourth embodiment of a connector 340 having a pair of flanges 48, 48*a* and associated tongues 46. The connector 340 is characterized by a flexible, bellows-type housing 342 which permits the angular orientation of the flanges 48, 48*a* to be adjusted. In all other respects the function and operation of the flexible connector 340 is identical to that of the straight connector 140 previously described.

Figure 31:
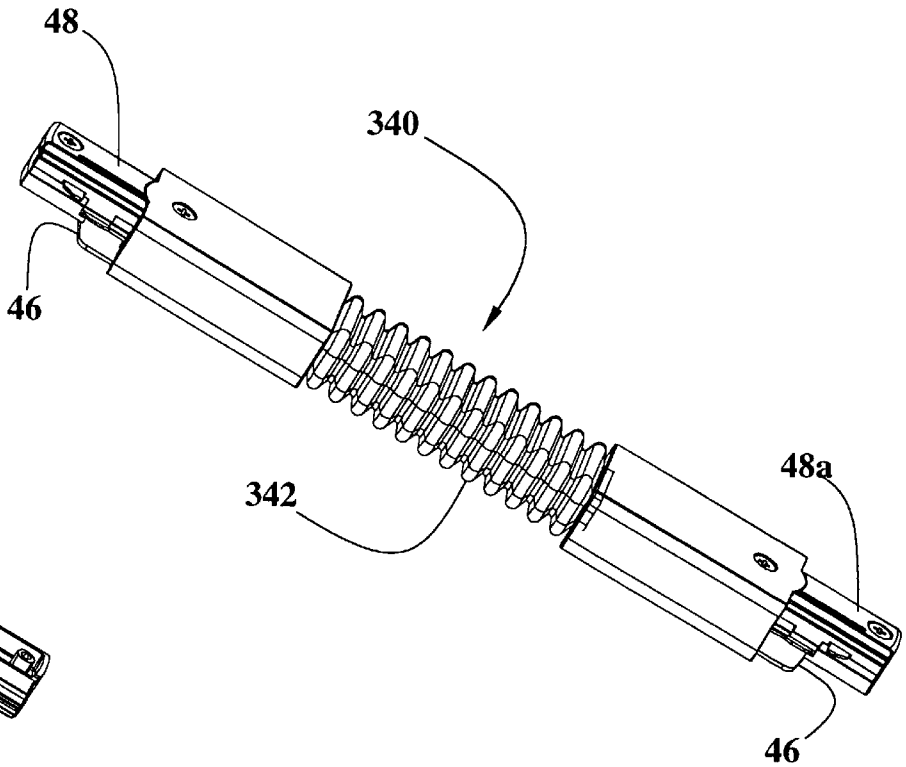
FIG. 31 is a bottom perspective view of the connector of FIG. 30.
Figure 30:
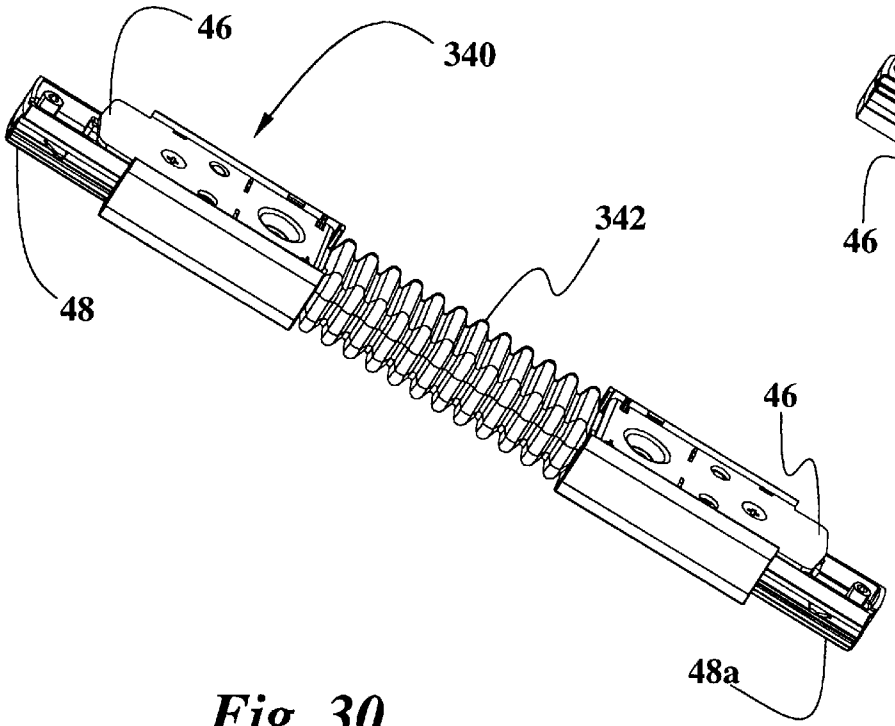
FIG. 30 is a top perspective view of a fourth embodiment of a connector according to the present invention, being adapted to flexibly connect two adjacent track sections at varying angles.

FIGS. 30 and 31 show a connector 440 for connecting three sections of track 10 at a common junction. The connector 440 includes three flanges 48, 48*a*, and 48*b*, each having an associated tongue 46. The flange 48*a* is a mirror image of the flange 48, while the flange 48*b* is identical to the flange 48. Connection to each section of track 10 is made by way of both a flange 48, 48*a*, or 48*b* and a tongue 46 engaging the respective track section. The connector 440 can be used to connect a powered section of track to two unpowered sections of track or can be used to connect three unpowered sections of track to an electrical panel by way of wires from the panel connected to terminals in the connector.

The connector 440 shown in FIGS. 30 and 31 is shaped like a "T" and is adapted to interconnect two collinear track sections and a perpendicular track section. A variation of the connector 440 is configured like a "Y" and is adapted to interconnect three track sections emanating from a single location and disposed at 120° angles with respect to one another.

Figure 32:
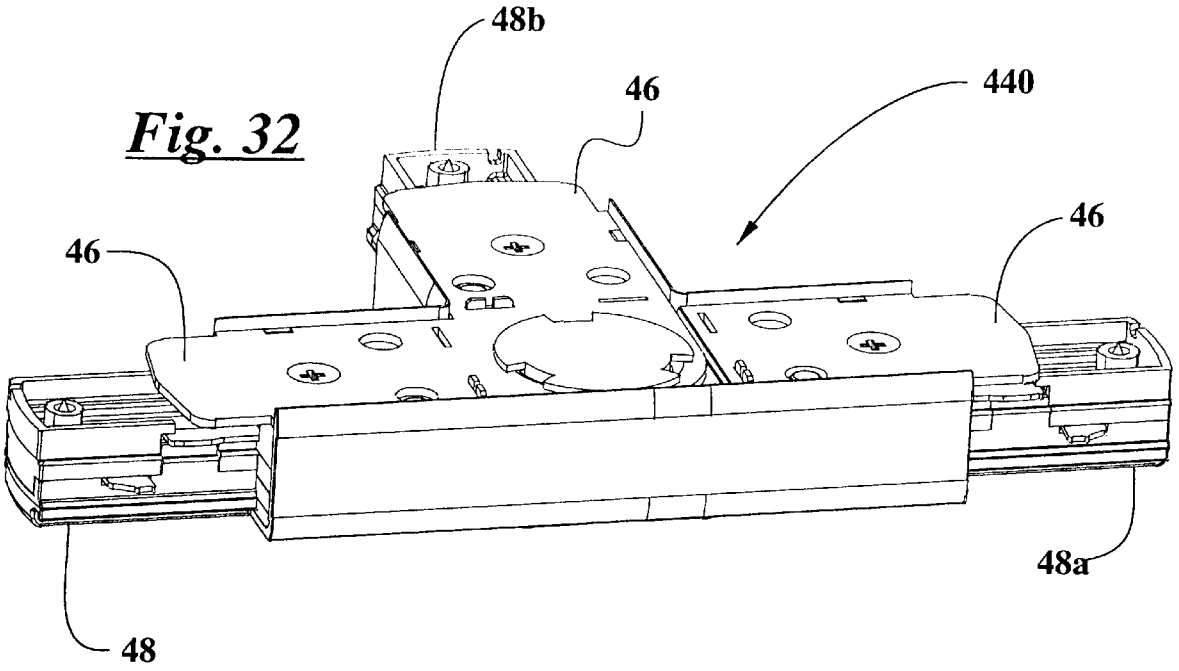
FIG. 32 is a top perspective view of a fifth embodiment of a connector according to the present invention, being adapted to connect two collinear track sections and a perpendicular track section in a "T" configuration.
Figure 33:
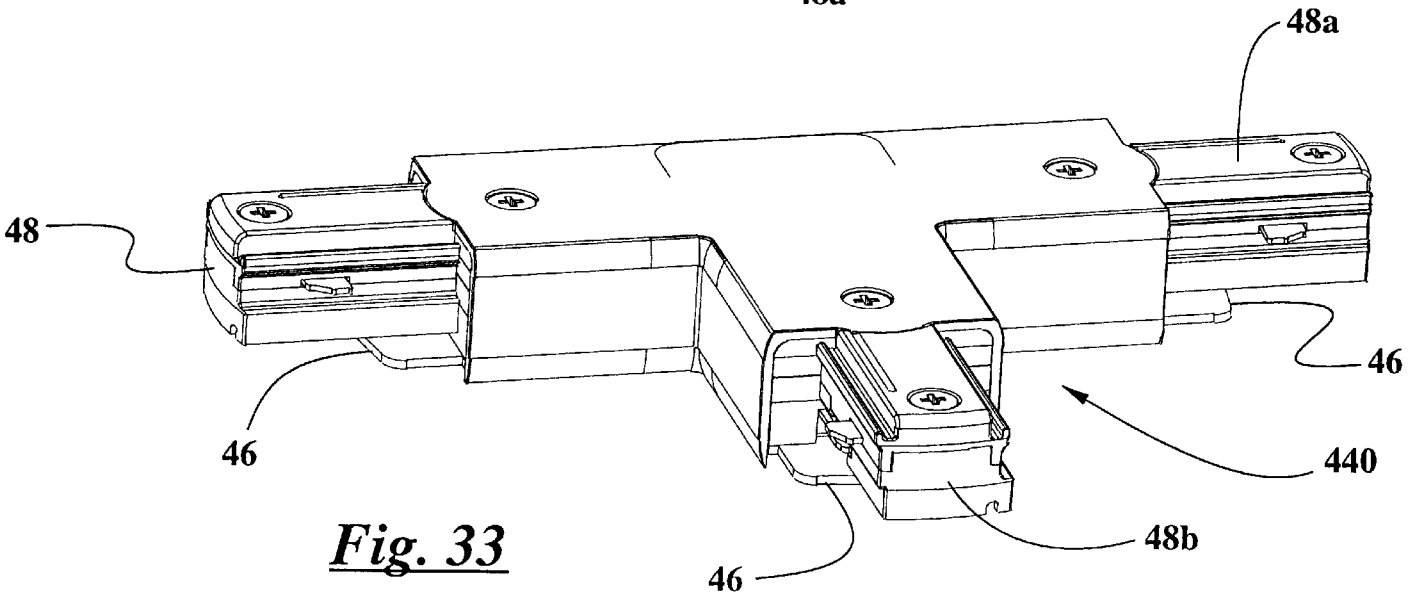
FIG. 33 bottom perspective view of the connector of FIG. 32.
Figure 34:
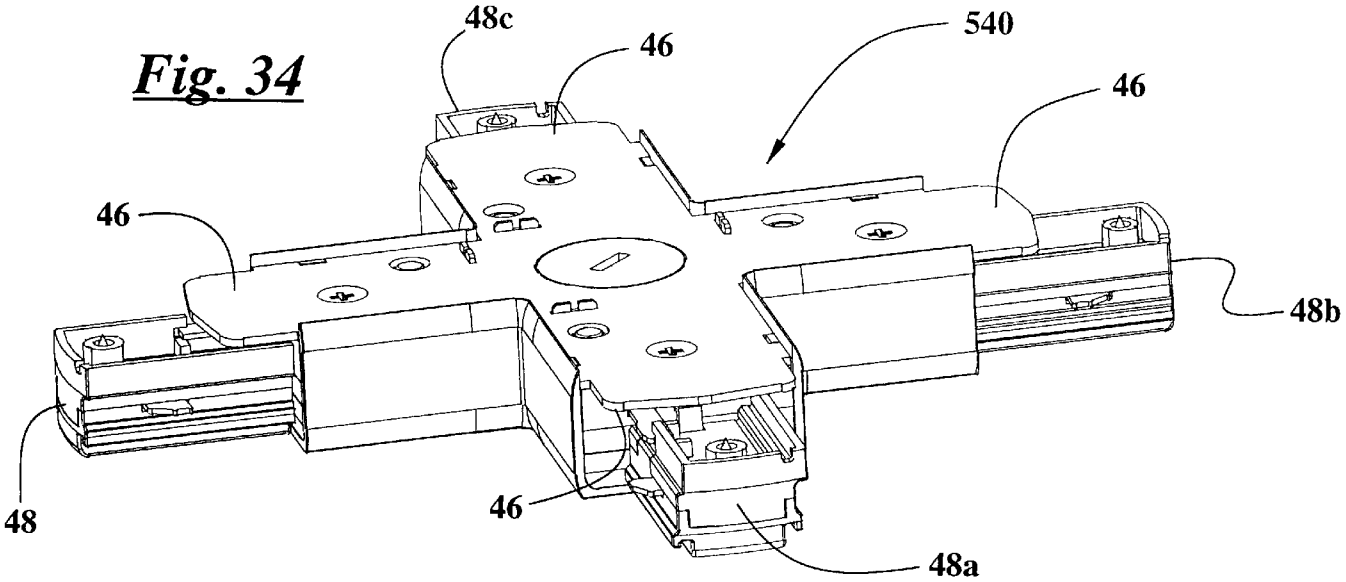
FIG. 34 is a top perspective view of a sixth embodiment of a connector according to the present invention, being adapted to connect four track sections in an "X" configuration.
Figure 35:
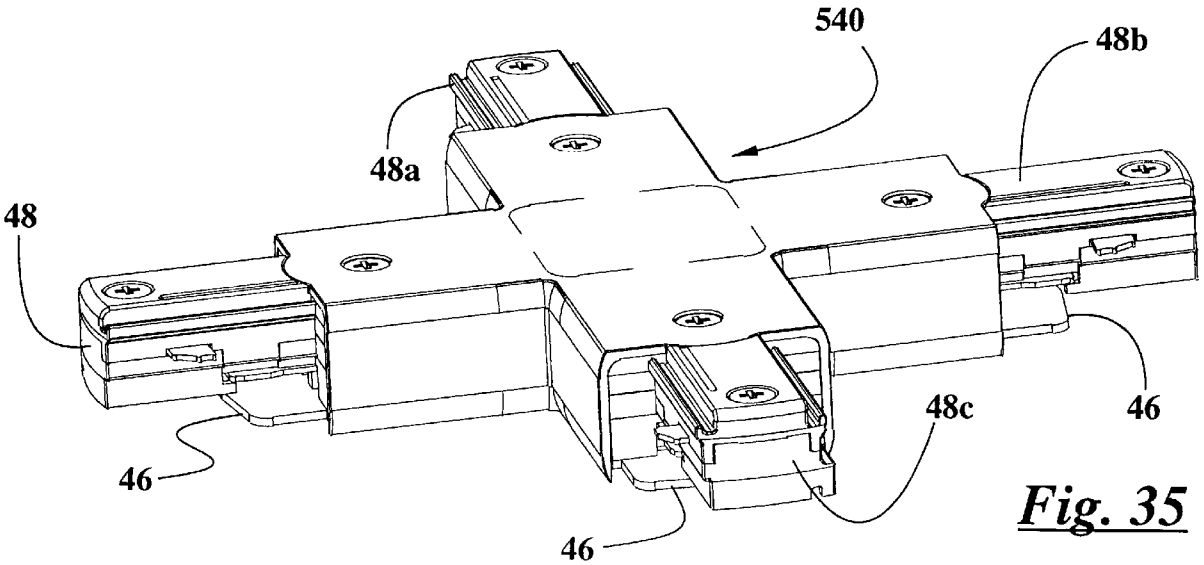
FIG. 35 is a bottom perspective view of the connector of FIG. 34.

FIGS. 32 and 33 illustrate a connector 540 adapted to physically and electrically connect four sections of track 10. The connector 540 includes four flanges 48, 48*a*, 48*b*, and 48*c*, each having an associated tongues 46. The flanges 48, 48*b* are identical, and the flanges 48*a*, 48*c* are identical and mirror images of the flanges 48, 48*b*. The connector 540 can be employed to connect a single powered piece of track 10 to three unpowered sections of track or, by way of electrical wires from an electrical panel, to supply power to four unpowered sections of track.

The connectors 40, 140, 240, 340, 440, and 540 hereinabove described provide several advantages over prior art connectors for track lighting systems. First the tongues strengthen the structural connection between the connectors and the track section. The enhanced structural connection withstands forces which would otherwise bend the connector at an angle with respect to the track.

In addition, while the connectors 40, 140, 240, 340, 440, and 540 of the disclosed embodiments all include ground contacts 54 which engage a corresponding grounding rib 17 on the track 10, the connectors can alternatively be grounded to the track 10 by way of the fit between the tongue 46 and the channels 34, 35 of the track 10. In this arrangement the ground contact 54 can be eliminated, thus reducing the cost and complexity of the connectors. Further the grounding rib 17 can be eliminated from the track 10, thus reducing the cost and complexity of the track extrusion.

Finally, it will be understood that the preferred embodiment has been disclosed by way of example, and that other modifications may occur to those skilled in the art without departing from the scope and spirit of the appended claims.

What is claimed is:

1. A track lighting system in which a light fixture is physically and electrically connected to a track, comprising:

an elongated track having a central longitudinal passageway, said track having a voltage bus, a neutral bus, and a grounding element disposed within said central longitudinal passageway;

said track further comprising means disposed above said central longitudinal passageway for defining a pair of opposing channels; and a connector, said connector comprising a housing and a flange extending from said housing, said flange being received within an end of said central longitudinal passageway of said track by way of an interference fit, and said flange having electrical contacts disposed thereon for engaging said voltage bus, said neutral bus, and said grounding element disposed within said central longitudinal passageway;

said connector further comprising a tongue extending from said housing spaced apart from and generally parallel to said flange and having edge portions which engage said opposing channels in an interference fit;

whereby said tongue engaging said opposing channels of said track contributes to the mechanical integrity of the connection between said connector and said track.

2. The track lighting system of claim 1, wherein said connector further comprises a base plate which is mounted to said housing, and wherein said tongue comprises a portion of said base plate extending forward of said housing.

3. The track lighting system of claim 1, further comprising electrical wires operatively associated with said connector for placing said contacts in conductive communication with a source of electrical power.

4. The track lighting system of claim 1, wherein said track comprises a first track, wherein said flange comprises a first flange, wherein said tongue comprises a first tongue, and wherein said track lighting system further comprises a second elongated track having a central longitudinal passageway, said track having a voltage bus, a neutral bus, and a grounding element disposed within said central longitudinal passageway;

wherein said second track further comprises means disposed above said central longitudinal passageway for defining a pair of opposing channels; and wherein said connector further comprises a second flange being received within an end of said central longitudinal passageway of said second track by way of an interference fit, said second flange having electrical contacts disposed thereon for engaging said voltage bus, said neutral bus, and said grounding element disposed within said central longitudinal passageway of said second track; and wherein said connector further comprises a second tongue extending from said housing spaced apart from and generally parallel to said second flange and having edge portions which engage said opposing channels of said second track in an interference fit.

5. The track lighting system of claim 4, wherein said connector is configured such that said flanges are generally collinear.

6. The track lighting system of claim 4, wherein said connector is configured such that said flanges are generally perpendicular to one another.

7. The track lighting system of claim 4, wherein said housing is flexible such that said flanges can be oriented at varying angles with respect to one another.

8. The track lighting system of claim 4, further comprising:

a third elongated track having a central longitudinal passageway, said third track having a voltage bus, a neutral bus, and a grounding element disposed within said central longitudinal passageway;

said third track further comprising means disposed above said central longitudinal passageway for defining a pair of opposing channels;

said connector further comprising a third flange being received within an end of said central longitudinal passageway of said third track by way of an interference fit, said third flange having electrical contacts disposed thereon for engaging said voltage bus, said neutral bus, and said grounding element disposed within said central longitudinal passageway of said third track; and wherein said connector further comprises a third tongue extending from said housing spaced apart from and generally parallel to said third flange and having edge portions which engage said opposing channels of said third track in an interference fit.

9. The track lighting system of claim 8, wherein said first and second flanges are generally collinear, and wherein said third flange is generally perpendicular to said first and second flanges.

10. The track lighting system of claim 8, wherein said first, second, and third flanges are located generally within the same plane and extend from said housing at approximately 120° angles with respect to one another.

11. The track lighting system of claim 8, further comprising:

a fourth elongated track having a central longitudinal passageway, said fourth track having a voltage bus, a neutral bus, and a grounding element disposed within said central longitudinal passageway;

said fourth track further comprising means disposed above said central longitudinal passageway for defining a pair of opposing channels;

said connector further comprising a fourth flange being received within an end of said central longitudinal passageway of said fourth track by way of an interference fit, said fourth flange having electrical contacts disposed thereon for engaging said voltage bus, said neutral bus, and said grounding element disposed within said central longitudinal passageway of said fourth track; and wherein said connector further comprises a fourth tongue extending from said housing spaced apart from and generally parallel to said fourth flange and having edge portions which engage said opposing channels of said fourth track in an interference fit.

12. The track lighting system of claim 11, wherein said first and second flanges are generally collinear, said third and fourth flanges are generally collinear, and wherein said first and second flanges are disposed generally perpendicular to said third and fourth flanges.

13. A track lighting system in which a light fixture is physically and electrically connected to a track, comprising:

an elongated track having a central longitudinal passageway, said track having a voltage bus and a neutral bus disposed within said central longitudinal passageway;

said track further comprising means disposed above said central longitudinal passageway for defining a pair of opposing channels; and a connector, said connector comprising a housing and a flange extending from said housing, said flange being received within an end of said central longitudinal passageway of said track by way of an interference fit, and said flange having electrical contacts disposed thereon for engaging said voltage bus and said neutral bus disposed within said central longitudinal passageway;

said connector further comprising a tongue extending from said housing spaced apart from and generally parallel to said flange and having edge portions which engage said opposing channels in an interference fit, said interference fit between said tongue of said connector and said opposing channels of said track being operative to electrically ground said connector to said track.

* * * * *